United States Patent [19]

Schuster

[11] Patent Number: 4,561,159

[45] Date of Patent: Dec. 31, 1985

[54] ADAPTER FOR REMOVING DIESEL ENGINE FUEL INJECTORS

[76] Inventor: David V. Schuster, 1568 Cohassett Ave., Lakewood, Ohio 44107

[21] Appl. No.: 582,828

[22] Filed: Feb. 23, 1984

[51] Int. Cl.[4] ..... B25B 19/00

[52] U.S. Cl. ..... 29/255; 29/275

[58] Field of Search ..... 72/457, 705; 87/463; 29/254, 255, 275

[56] References Cited

U.S. PATENT DOCUMENTS 2,934,984 5/1960 Woodman ..... 81/463

3,750,500 8/1973 Peterson ..... 29/255

4,034,594 7/1977 Morgan ..... 29/275

*Primary Examiner*—Robert C. Watson

*Attorney, Agent, or Firm*—James A. Hudak

[57] ABSTRACT

A device which assists in the removal of diesel engine fuel injectors is disclosed. The device is an adapter (10) which has longitudinal openings (34, 36) therein permitting its receipt on a fuel injector assembly. A pocket (40) is provided at one end of the adapter (10) for engagement with a gripping member provided on the fuel injector assembly. The other end of the adapter (10) can be attached to an impacting device for the removal of the fuel injector.

2 Claims, 3 Drawing Figures

ADAPTER FOR REMOVING DIESEL ENGINE FUEL INJECTORS

TECHNICAL FIELD

This invention generally relates to an adapter for a tool and more particularly to a tool adapter which permits the easy removal of a fuel injector from a diesel engine.

BACKGROUND ART

Typically, the fuel injectors utilized in diesel engines are located in very inaccessible places. Because of this inaccessibility, the removal of these injectors for replacement or maintenance purposes is a difficult task. This task is made more difficult by the fact that dirt and deposits usually accumulate around the injectors at their point of entrance into the engine. The removal process is further hindered by the lack of tools designed specifically for the removal process and thus general purpose tools, such as vise grips, must be used. Thus, it is easy to appreciate that the removal of fuel injectors from a diesel engine can be a very formidable task.

Because of this, it has become desirable to develop a tool or adapter for same to assist in the removal of fuel injectors from diesel engines.

SUMMARY OF THE INVENTION

The present invention solves the aforementioned problems associated with the prior art as well as other problems by providing an adapter which grippingly engages the fuel injector to assist in its removal. The adapter has longitudinal openings therein permitting its receipt on the fuel injector while installed in the engine. A hexagonal pocket is provided at one end of the adapter to receive the hexagonal gripping member typically provided on the fuel injector assembly. In this manner, the adapter can grippingly engage the fuel injector. The adapter is also provided with attachment means at the other end thereof to permit the attachment of removal tools, such as an impacting device, thereto.

DESCRIPTION OF THE PREFERRED EMBODIMENT

Figure 1:
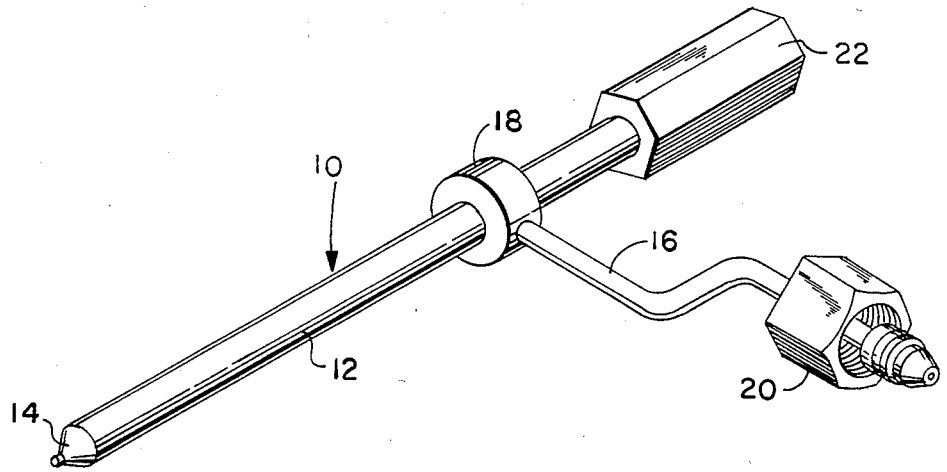
FIG. 1 is a perspective view of a state-of-the-art fuel injector for a diesel engine.

Referring now to the drawings where the illustrations are for the purpose of describing the preferred embodiment of the present invention and are not intended to limit the invention hereto, FIG. 1 shows a state-of-the-art fuel injector device 10 for a diesel engine. This device 10 is comprised of a longitudinally extending tubular injector nozzle 12 having an injector tip 14 at one end thereof, a formed fuel supply tube 16 connected to the tubular injector nozzle 12 by a fitting 18 intermediate its ends, a collar nut 20 which is received over the end of the fuel supply tube 16 to provide a means for attachment of the injector device 10 to the supply of diesel fuel, and a longitudinally extending hexagonal gripping member 22 located at the end of the tubular injector nozzle 12 opposite the injector tip 14. When installed in a diesel engine (not shown), the tubular injector nozzle 12 is received through the wall of the engine so that the injector tip 14 is positioned within the combustion chamber of an engine cylinder while the fuel supply tube 16 and the hexagonal gripping member 22 are located external to the engine. In order to remove the injector device 10 from the engine, the hexagonal gripping member 22 must be securely engaged by some external means, such as vise grips or the like, and the device 10 must be pulled out of the engine. This removal procedure has proven to be very difficult because of the lack of access to the hexagonal gripping member 22 with conventional removal tools.

Figure 2:
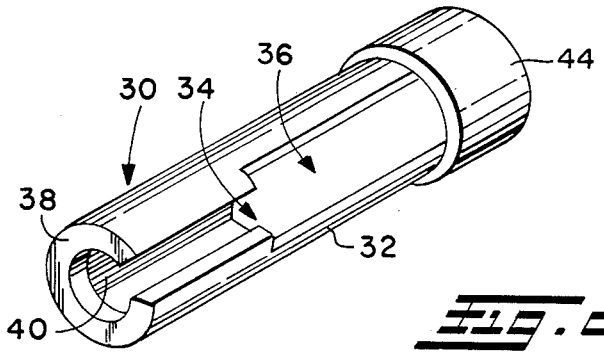
FIG. 2 is a perspective view of the present invention.
Figure 3:
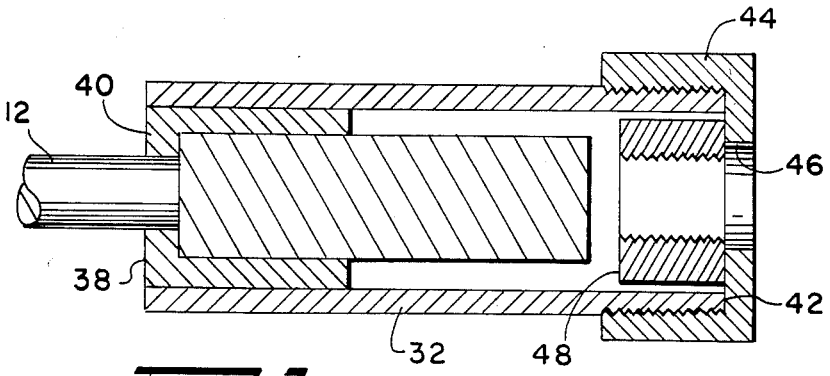
FIG. 3 is a front plan view, partially broken away in cross-section, showing the installation of the present invention on a state-of-the-art fuel injector for a diesel engine.

The present invention, shown in FIG. 2, is a removal tool adapter 30 which, in use, engages the hexagonal gripping member 22 of the injector device 10 permitting the removal thereof from a diesel engine. As such, this removal tool adapter 30 is comprised of an outer sleeve 32 having an internal diameter greater than the diameters of the tubular injector nozzle 12 and the hexagonal gripping member 22. A portion of the outer wall of the sleeve 32 is removed for its entire length providing longitudinally extending openings, shown generally by the numerals 34 and 36, therein. The transverse width of the longitudinal opening 34 is slightly greater than the diameter of the tubular injector nozzle 12 whereas the transverse width of the longitudinal opening 36 is slightly greater than the diameter of the hexagonal gripping member 22. In addition, the axial length of the longitudinally extending opening 34 is slightly less than the axial distance between the inward end of the hexagonal gripping member 22 and the adjacent end of the fitting 18. In this manner, the adapter 30 can be received over the tubular injector nozzle 12 and the hexagonal gripping member 22 when the forward end 38 of the adapter 30 is adjacent the fitting 18.

A hexagonal pocket 40 is provided inwardly of the forward end 38 of the adapter 30 and is attached to the outer sleeve 32 by standard techniques, such as welding, etc. Alternatively, if the adapter is cast or forged, this hexagonal pocket 40 can be formed in the casting or forging. A longitudinally extending opening having a transverse width and an axial length corresponding to longitudinal opening 34 is also provided in this hexagonal pocket 40. The hexagonal pocket 40 is sized so as to be capable of receiving and engaging the hexagonal gripping member 22 of the injector device 10.

The outer surface of the sleeve 32 adjacent the rearward end 42 thereof is threaded for the receipt of a collar nut 44, having an aperture 46 therein. A threaded member 48, such as a nut, is provided within the collar nut 44 and is aligned with the aperture 46 to threadingly engage a handle (not shown) of an impacting device, or the like, when the adpater 30 is in use.

In order to use the adapter 30, the forward end 38 of the adapter 30 is positioned adjacent to and parallel to the injector device 10 so that its forward end 38 is adjacent the fitting 18. The adapter 30 is then moved transversely with respect to the injector device 10 so that the injector fuel nozzle 12 is received through the longitudinal opening 34 and the hexagonal gripping member 22 is received through the longitudinal opening 36. The adapter 30 is then moved axially with respect to the fuel injector nozzle 12 so that the hexagonal pocket 40 firmly engages the hexagonal gripping member 22. The collar nut 44, with the threaded member 48 therein, is then threadably engaged to the rearward end of the adapter 30. A handle of a impacting device, or the like, is then received through the aperture 46 and engages the threaded member 48 resulting in the attachment of the impacting device to the adapter 30. By subsequent operation of the impacting device, the injector device 10 can be easily removed from the engine.

Certain modifications and improvements will occur to those skilled in the art upon reading the foregoing. It should be understood that all such modifications and improvements have been deleted herein for the sake of conciseness and readability, but are properly within the scope of the following claims.

I claim:

1. An adapter for a tool utilized for engaging fuel injector nozzles or the like comprising a sleeve member having a longitudinally extending opening therein throughout its entire length, said longitudinally extending opening comprising a first longitudinally extending opening and a second longitudinally extending opening, said first and second longitudinally extending openings being contiguous and joined at a location intermediate the ends of said sleeve member, said first longitudinally extending opening being located adjacent one end of said sleeve member and having a transverse width less than the transverse width of said second longitudinally extending opening, a pocket provided in said one end of said sleeve member, said pocket having a longitudinally extending opening therein coincident with said first longitudinally extending opening in said sleeve member and having a plurality of longitudinally extending side surfaces and a base surface complementary to the configuration of a portion of the fuel injector nozzle to be engaged permitting the surfaces defining the sides of the portion of the fuel injector nozzle and a transverse surface thereon to be engageable with said complementary longitudinally extending side surfaces and said base surface of said pocket, and means for attaching said sleeve member to the removal tool, said attaching means being removably attachable to the other end of said sleeve member.

2. The device as defined in claim 1 wherein said attaching means comprises means for substantially closing said other end of said sleeve member, and a threaded fastener received within said sleeve member adjacent said other end of said sleeve member, said closing means having an aperture therein permitting access to said threaded fastener.

* * * * *